United States Patent [19]

Miyata et al.

[11] Patent Number: 4,844,340

[45] Date of Patent: Jul. 4, 1989

[54] METHOD AND APPARATUS FOR SPRAYING AN INORGANIC HYDRAULIC MATERIAL COMPOSITION CONTAINING REINFORCING SHORT FIBERS

[75] Inventors: Shohiko Miyata, Tokyo; Seiichi Tottori, Fuchu; Sakae Ushijima, Tokyo; Hajime Suzuki, Yokosuka; Toshikazu Minematsu, Narashino; Yoshiki Tanaka, Tokyo, all of Japan

[73] Assignees: Railway Technical Research Institute; Sumitomo Cement Co., Ltd., both of Tokyo, Japan

[21] Appl. No.: 76,257

[22] Filed: Jul. 21, 1987

[30] Foreign Application Priority Data

Jul. 30, 1986 [JP] Japan ..... 61-179366
Jul. 1, 1987 [JP] Japan ..... 62-165071

[51] Int. Cl.[4] ..... E04G 21/02

[52] U.S. Cl. ..... 239/9; 239/10; 239/311; 239/379; 239/427.5; 366/5; 366/10; 366/102; 406/48; 406/68

[58] Field of Search ..... 239/8–10, 239/304, 307, 310, 311, 379, 427.3, 427.5, 428, 589, 591, 590.5, 430, 431; 366/3, 5, 10, 13, 101, 102, 106; 406/46–48, 66–68, 124

[56] References Cited

U.S. PATENT DOCUMENTS

| | | | |
|---|---|---|---|
| 1,507,773 | 9/1924 | Hamm | 239/591 X |
| 4,154,486 | 5/1979 | Nishikawa | 406/48 |
| 4,225,086 | 9/1980 | Sardell | 239/428 |
| 4,239,397 | 12/1980 | Sardell et al. | 366/3 |
| 4,440,499 | 4/1984 | Tomikawa et al. | 366/3 |

FOREIGN PATENT DOCUMENTS

| | | | |
|---|---|---|---|
| 663804 | 5/1979 | U.S.S.R. | 239/307 |
| 1589169 | 5/1981 | United Kingdom . | |

OTHER PUBLICATIONS

Search Report from GB 8717935.

*Primary Examiner*—Andres Kashnikow
*Attorney, Agent, or Firm*—Armstrong, Nikaido, Marmelstein, Kubovcik & Murray

[57] ABSTRACT

An inorganic hydraulic material composition containing reinforcing short fibers is sprayed without breakage thereof, by fluidizing reinforcing short fibers in a blast of compressed air, by blending the flow of the reinforced short fibers fluidized in the blast of compressed air with a dry mixture of an inorganic hydraulic material such as cement with an aggregate such as sand in a dry blending region, by introducing the resultant dry blend into a water-mixing region, by mixing the dry blend with water, and by spraying the resultant wet composition through a spray nozzle.

18 Claims, 8 Drawing Sheets

METHOD AND APPARATUS FOR SPRAYING AN INORGANIC HYDRAULIC MATERIAL COMPOSITION CONTAINING REINFORCING SHORT FIBERS

BACKGROUND OF THE INVENTION

1. Field of the Invention

The present invention relates to a method and apparatus for spraying an inorganic hydraulic material composition containing reinforcing short fibers. More particularly, the present invention relates to a method and apparatus for spraying an inorganic hydraulic material composition in which reinforcing short fibers are uniformly distributed without breakage and intertwinement of the fibers.

2. Description of the Related Art

Various known methods and apparatuses for spraying an aqueous slurry containing an inorganic hydraulic material such as a cement, an aggregate such as sand, and reinforcing short fibers such as glass or metal fibers are utilized in the civil engineering, construction, and building industries.

In the known methods and apparatus, the inorganic hydraulic material and the aggregate are mixed with the reinforcing short fibers in water, and the resultant aqueous slurry is sprayed through a spraying nozzle.

Usually, the reinforcing short fibers are prepared by cutting a fibrous bundle of a number of filaments to a desired length. Therefore, the reinforcing short fibers are usually supplied in the form of bundles of short cut fibers which are parallel to each other.

It is well known that it is very difficult to release the short fibers from the bundles and to evenly disperse and distribute the released short fibers in water. That is, it is very difficult to prepare an aqueous slurry of the inorganic hydraulic material wherein the reinforcing short fibers are uniformly dispersed and evenly distributed. When an aqueous slurry in which the reinforcing short fibers are unevenly mixed with the inorganic hydraulic material in water is sprayed and allowed to harden (solidify), the resultant hardened structure exhibits an unsatisfactory mechanical strength. Therefore, the individual short fibers must be completely released from the bundles and the released individual short fibers evenly mixed with the inorganic hydraulic material.

Accordingly, to ensure a complete release of the individual short fibers from the bundles and a uniform dispersal of the released individual short fibers in water, a specific exclusive mixer, for example, an OMNI type mixer, must be used.

This necessity for a specific exclusive mixer greatly restricts the scope of application of the aqueous slurry containing the reinforcing short fibers in the civil engineering, construction and building industries. Also, the mixing by the specific exclusive mixer results in undesirable breakage, intertwinement, and/or fibrillation of the reinforcing short fibers. Further, mixing in water promotes an undesirable absorption of water by the reinforcing short fibers, which have a relatively large surface area, and this water absorption sometimes promotes an undesirable deterioration of the reinforcing short fibers, resulting in a decrease in the toughness of the short fibers. Accordingly, a satisfactory reinforcing effect of the short fibers cannot be obtained from an aqueous slurry of the inorganic hydraulic material in which the reinforcing short fibers are dispersed by the specific exclusive mixer.

Furthermore, when an aqueous slurry of the inorganic hydraulic material containing the reinforcing short fibers, for example, short metal fibers, is sprayed onto a surface of a wall, the distribution of the inorganic hydraulic material and the reinforcing short fibers in the resultant aqueous slurry layer on the wall surface is uneven because of the difference in specific gravity thereof. That is, the metal fibers have a large specific gravity and strongly rebound from the wall surface, and therefore, the distribution of the reinforcing short metal fibers in a portion of the hardened layer closest to the wall surface is smaller than that in a surface portion thereof furthest from the wall surface. This results in an unsatisfactory reinforcing effect of the short fibers in the hardened layer, and the metal fibers located in the surface portion of the hardened layer are easily corroded by corrosive gases, for example, oxygen, moisture, and/or a corrosive mist, for example, salt mist.

Taking the above-mentioned circumstances into account, there is a strong demand for a new method and apparatus by which the inorganic hydraulic material can be evenly mixed with the reinforcing short fibers and can produce a uniform spray of the resultant evenly mixed composition of the inorganic hydraulic material and the reinforcing short fibers.

SUMMARY OF THE INVENTION

An object of the present invention is to provide a method and apparatus for spraying a composition containing an inorganic hydraulic material and reinforcing short fibers through a spray nozzle by a blast of compressed air, the reinforcing short fibers being completely separated from each other and evenly distributed in the inorganic hydraulic material composition.

Another object of the present invention is to provide a method and apparatus for spraying a composition containing an inorganic hydraulic material and reinforcing short fibers through a spray nozzle by a blast of compressed air without undesirable breakage, intertwinement, or fibrillation of the reinforcing short fibers.

Still another object of the present invention is to provide a method and apparatus for spraying a composition containing an inorganic hydraulic material and reinforcing short fibers through a spray nozzle by a blast of compressed air, which method and apparatus can be readily carried out by simple and easy procedures at a construction or building site.

A further object of the present invention is to provide a method and apparatus for spraying a composition containing an inorganic hydraulic material and reinforcing short fibers through a spray nozzle by a blast of compressed air, in which method and apparatus the spray pressure can be readily controlled.

The above-mentioned objects are attained by the method and apparatus of the present invention for spraying a composition containing an inorganic hydraulic material and a reinforcing material through a spraying nozzle by means of a compressed air blast.

The method of the present invention comprises the steps of:

fluidizing dry reinforcing short fibers in a flow of a blast of compressed air to provide a compressed air blast containing the dry reinforcing short fibers;

allowing a dry mixture of an inorganic hydraulic material with an aggregate to fall down into a dry blending region;

introducing the resultant flow of the dry reinforcing short fibers fluidized in the compressed air blast into the dry blending region, to provide a flow of a dry blend containing the inorganic hydraulic material, the aggregate, and the reinforcing short fibers;

introducing the flow of the dry blend into a water-mixing region, while spouting at least one flow of water into the water-mixing region, to provide a flow of a wet spraying composition containing the inorganic hdraylic material, the aggregate, and the reinforcing short fibers mixed with the spouted water and fluidized together in the air blast; and spraying the wet spraying composition through a spray nozzle.

The apparatus of the present invention comprises:

a fluidizing device having a fluidizing space formed therein and connected to a supply source of a blast of compressed air and to a supply source of reinforcing short fibers, whereby a flow of the reinforcing short fibers fluidized in the blast of compressed air is provided;

a dry blender having a dry blending space formed therein and connected to the fluidizing device and located below and connected to a supply source of a dry mixture of an inorganic hydraulic material and an aggregate, whereby the dry mixture is allowed to fall down into the dry blending space and a flow of a dry blend containing the inorganic hydraulic material, the aggregate, and the reinforcing short fibers fluidized in a blast of compressed air is provided;

a water-mixing device having a water-mixing space formed therein and connected to the dry blender, and a water-spouting device for spouting water into the water-mixing space, connected to a water supply source, whereby a flow of a wet composition containing the dry blend mixed with water and fluidized together in the blast of compressed air is provided; and a spray nozzle connected to the water-mixing device.

DESCRIPTION OF THE PREFERRED EMBODIMENTS

Figure 1:
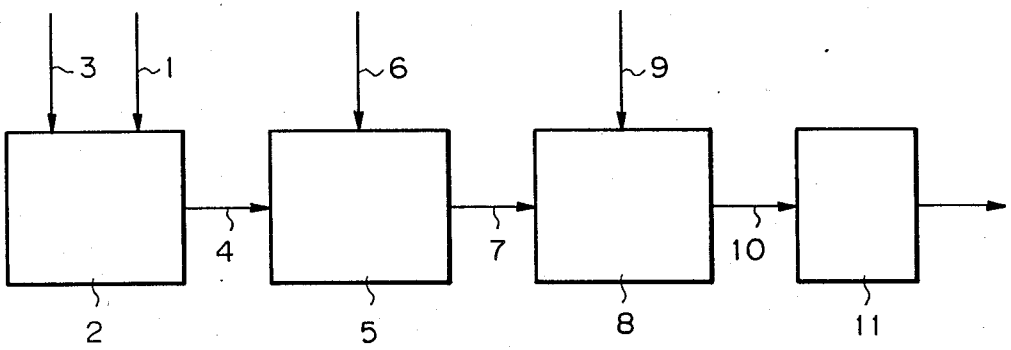
FIG. 1 is a flow chart of the method of the present invention.

Referring to FIG. 1 showing the method of the present invention, reinforcing short fibers 1 are fed into a fluidizing region 2 while a blast of compressed air 3 is blown into the fluidizing region 2 to provide a flow 4 of the reinforcing short fibers fluidized in the blast of compressed air 3.

The resultant flow 4 of the reinforcing short fibers fluidized in the blast of air 3 is introduced from the fluidizing region 2 into a dry blender 5 while a dry mixture 6 consisting of an inorganic hydraulic material and an aggregate is separately fed into the dry blender 5, to form a flow 7 of the resultant dry blend containing the inorganic hydraulic material, the aggregate, and the reinforcing short fibers evenly blended together and fluidized in the blast of compressed air.

The dry mixture 6 may be introduced into the dry blender 5 by an additional blast of compressed air (not shown in FIG. 1). In this embodiment, the resultant dry blend is fluidized in a merged air blast consisting of a mixture of the first blast of compressed air and the additional blast of compressed air.

The flow 7 of the dry blend is introduced into a water-mixing region 8, while at least one flow 9 of water is spouted into the water-mixing region 8 to provide a wet composition containing the inorganic hydraulic material, aggregate and reinforcing short fibers evenly mixed with water and fluidized together in the blast of compressed air.

Finally, the resultant flow 10 of the wet composition is sprayed through a spray nozzle 11.

In the method of the present invention, it is important that the dry reinforcing short fibers be evenly fluidized in a blast of compressed air before being mixed with the inorganic hydraulic material and the aggregate, and then evenly mixed with the dry mixture of the inorganic hydraulic material with the aggregate while they are evenly fluidized in the blast of compressed air, before they are mixed with water, and then the resultant dry blend evenly mixed with water while evenly fluidized in the blast of compressed air.

In the method of the present invention, the inorganic hydraulic material preferably comprises at least one member selected from the group consisting of cements, gypsum, and limestone, usually a cement.

The aggregate usable for the method of the present invention preferably comprises at least one member selected from the group consisting of sand, stone, and crushed rock.

The reinforcing short fibers usable for the present invention preferably comprise at least one type of short fibers selected from the group consisting of inorganic short fibers, for example, glass short fibers, carbon short fibers, and metal short fibers, for example, stainless steel short fibers; and organic short fibers, for example, aromatic polyamide short fibers.

Preferably, the reinforcing short fibers have an average diameter of from 10 $\mu$m to 1 mm and an average length of from 5 to 60 mm. Also, the reinforcing short fibers are preferably used in an amount of from 0.5% to 5% based on the volume of the spraying composition.

Preferably, the reinforcing short fibers are prepared by cutting a multifilament tow or bundle to a desired length to provide a number of bundles of short cut fibers. In the method of the present invention, the short fibers are fluidized in the dry state in a blast of compressed air. That is, the short fibers are completely separated from the bundles and the resultant individual short fibers are evenly fluidized in the blast of compressed air without breakage, intertwinement, or fibrillation thereof. Therefore, when the flow of the short fibers is introduced into the dry blending region, the short fibers are evenly blended in the dry state with the inorganic hydraulic material and the aggregate in the dry blending region.

The preparation of the reinforcing short fibers by cutting the multifilament tow or bundle is preferably carried out at the site at which the spraying procedure is carried out. That is, preferably the multifilament tow-cutting operation is carried out at the supply source of the short fibers and the resultant cut short fiber bundles then fed to the blending region. This is advantageous in that the control of the feed rate of the reinforcing short fibers is simplified and more precise.

In an example of the process of the present invention, in a dry blending region, a dry mixture of an inorganic hydraulic material with an aggregate is fluidized in a flow of an additional blast of compressed air and the resultant flow of the dry mixture is blended with a flow of the dry reinforcing short fibers fluidized in blast of a first compressed air, the resultant blend is fluidized in a flow of a merged blast of air consisting of a mixture of the compressed air blast flow with the additional compressed air blast flow, to provide a flow of the dry blend, and in the water-mixing region, the flow of the dry blend is mixed with water and is fluidized in the flow of the merged blasts of air to provide a wet spraying composition. The wet spraying composition is then sprayed through a spray nozzle by the merged blasts of air.

In the above-mentioned method in accordance with the present invention, preferably the flow of the short fibers fluidized in the first blast of compressed air is ejected into the dry blending region concurrently with the flow of the dry mixture fluidized in the second compressed air blast. This effectively prevents an excessive disturbance of the merged flow and avoids undesirable breakage, intertwinement, or fibrillation of the short fibers.

The flow of the dry blend comprised of the inorganic hydraulic material, the aggregate, and the reinforcing short fibers is mixed with at least one flow of water in the water-mixing region to provide a wet spraying composition. Preferably, the flow of water is fed in a direction intersecting the direction of the flow of the dry blend-containing merged blasts of compressed air. The fed water is effectively atomized by the merged blasts of compressed air flowing through the watering region, and the atomized water particles are very quickly and evenly mixed with the dry blend to provide a uniform flow of the wet composition.

The water is fed in an amount sufficient to harden the inorganic hydraulic material, preferably of from 30% to 70% based on the weight of the inorganic hydraulic material in the dry blend.

The flow of the wet spraying composition is introduced into a spray nozzle and sprayed through a front open end of the spray nozzle toward a surface to be coated by the inorganic hydraulic material composition containing the reinforcing short fibers.

Preferably, the flow of the wet spraying composition is disturbed while it flows through the spraying nozzle. This disturbance enhances the evenness of the wet sprayed composition.

Figure 2:
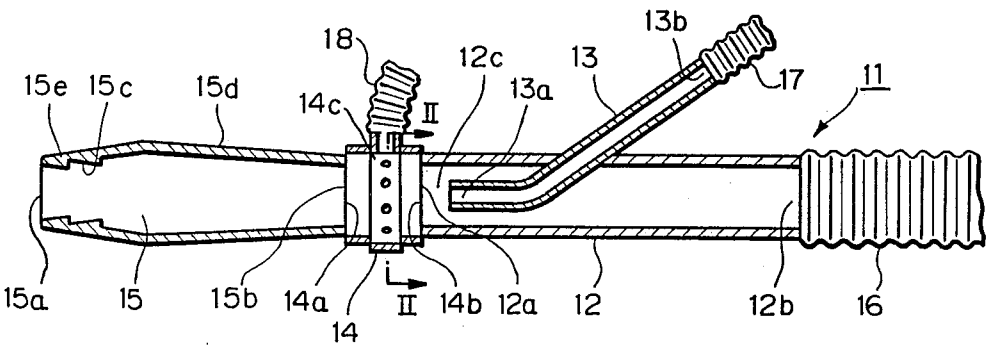
FIG. 2 is a cross-sectional view of an embodiment of the apparatus of the present invention.
Figure 3:
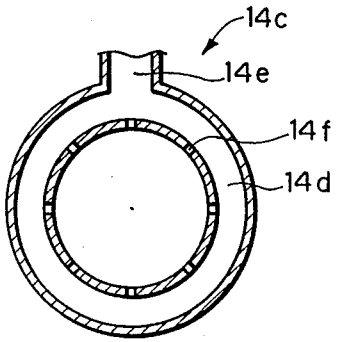
FIG. 3 is a cross-sectional view of the water-mixing device taken along the line II—II in FIG. 2.

Referring to FIGS. 2 and 3, the apparatus 11 of the present invention comprises a dry blending tube 12, a dry reinforcing short fiber-feeding pipe 13, a water-mixing tube 14, and a spraying nozzle 15. The blending tube 12 is made from a steel, aluminum alloy or ceramic tube having a front open end 12*a* and a rear open end 12*b*. The rear open end 12*b* is connected to a supply source (not shown) of a dry blend of an inorganic hydraulic material and an aggregate, and to a supply source (not shown) of compressed air, through a flexible (rubber) hose 16.

A dry blending region 12*c* is formed in a front end portion of the blending tube 12.

The feed pipe 13 has a front open end 13*a* and a rear open end 13*b* and has a smaller diameter than that of the blending tube 12. The front open end 13*a* is inserted into the dry blending region 12*c* in the blending tube 12 through the peripheral wall of the blending tube 12 to form a dry blending region 12*c* in front of the front open end 13*a* of the feeding tube 13 in the blending tube 12. The rear open end 13*b* is connected to a supply source (not shown) of the dry reinforcing short fibers and to a supply source (not shown) of a compressed air, through a flexible (rubber) hose 17. The dry reinforcing short fibers are fluidized in the compressed air in the feed pipe 13.

Preferably, the location of the front open end 13*a* of the feeding pipe 13 is movable along the longitudinal axis of the blending tube 12 to adjust the area of the dry blending region 12*c*.

Preferably, the front end portion of the feeding pipe 13 extends along the longitudinal axis (not shown) of the blending tube 12 toward the front open end 12*a* of the blending tube 12 so that a flow of the reinforcing short fibers is concurrent with the flow of the dry mixture.

The supply source of the reinforcing short fibers may be provided with means for cutting a reinforcing multifilament bundle (tow) to a desired length to provide the reinforcing short fibers. The cut fiber bundles are introduced into the flexible hose 17 by the second blast of compressed air and are fluidized in this blast of air so that individual short fibers are released from the bundles and evenly distributed in the blast of air.

The water-mixing tube 14 defines a water-mixing region and has a front open end 14*a* and a rear open end 14*b* and is provided with a means (14*c*) for feeding water therein. The rear open end 14*b* is connected to the front open end 12*a* of the blending tube 12. The water-feeding means 14*c* as shown in FIGS. 2 and 3 comprises an annular water chamber 14*d* and a water conduit 14*e* connected to a supply source (not shown) of water through a flexible (rubber) hose 18. The annular water chamber 14*d* has one or more water-feeding holes 4*f* through which water is fed into the water-mixing region 14. The water-feeding holes 14*f* are preferably formed so that the directions of the flows of water fed therethrough intersect the direction of the flow of the dry blend fed into the water-mixing region 14, preferably at an intersecting angle of 45 to 135 degrees, more preferably, 90 degrees. This feature causes the water fed into the water-mixing region 14 to be atomized by the flow of the merged blasts of air, and the atomized water particles are evenly distributed in the flow of the merged blasts of air and are uniformly mixed with the dry blend.

The spray nozzle 15 has a front open end 15*a* and a rear open end 15*b* thereof connected to the front open end 14*a* of the water-mixing tube 14.

A wet composition consisting of the inorganic hydraulic material, the aggregate, the reinforcing short fibers, and the water is introduced from the water-mixing region 14 into the spray nozzle 15 through the rear open end 15*b* of the nozzle, and is then sprayed through the front open end 15*a* of the nozzle 15.

Preferably, the spray nozzle 15 is designed so that the flow of the wet composition is disturbed therein, to enhance the evenness in distribution of the components of the wet composition.

To this end, as shown in FIG. 2, preferably at least one flow-disturbing terrace 15*c* is formed on the inside peripheral surface of the spray nozzle 15. Also, preferably the spray nozzle 15 is composed of a rear portion 15*d* connected to the front open end 14*a* of the watering tube 14 and having a diameter which increases with an increase in the distance from the rear open end 15*b* of the nozzle 15, and a front portion 15*e* connected to the rear portion 15*d* and having a diameter which decreases with an increase in the distance from the rear open end 15*b* of the nozzle 15. That is, in this type of the spray nozzle 15 shown in FIG. 2, the cross-sectional area of the nozzle 15 at right angles to the longitudinal axis of the nozzle 15 increases and then decreases with an increase in the distance from the rear open end 15*b*.

In the method and apparatus of the present invention, as shown in FIGS. 2 and 3 the inorganic hydraulic material and the aggregates can be evenly blended with the reinforcing short fibers, and then with water, without undesirable breakage, intertwinement, or fibrillation of the short fibers, and the resultant wet composition can be readily sprayed onto a target surface.

In the above-mentioned method, a flow of reinforcing short fibers fluidized in a blast of compressed air is blended with a flow of a dry mixture of an inorganic hydraulic material and an aggregate fluidized in an additional blast of compressed air in a dry blending region. To smoothly and evenly carry out the dry blending procedure, the pressures of the first blast of compressed air and the additional blast of compressed air must be carefully controlled, which complicates the procedures of this method.

To eliminate this difficulty, in another aspect of the method of the present invention, a dry mixture of an inorganic hydraulic material with an aggregate is introduced into the dry blending region by a gravity feed and is mixed with and fluidized in the flow of the dry reinforcing short fiber-containing blast of compressed air, to provide a flow of the dry blend fluidized in the blast of compressed air. The flow of the dry blend is then mixed with water in the water-mixing region while fluidized in the flow of the blast of compressed air, to provide the wet spraying composition.

The above-mentioned method is advantageous in that all steps of the procedure can be effected by using only one flow of a blast of compressed air generated by a single air compressor, and thus control of the blast of compressed air is simple. Also, in the above-mentioned method, undesirable breakage and fibrillation of the reinforcing short fibers is kept to a very small amount of 10% or less.

Furthermore, in the above-mentioned method, the reinforcing short fiber-fluidizing region, the dry blending region, the water-mixing region, and the spray nozzle can be arranged separate from each other, and therefore, the weight of the spray nozzle can be reduced.

Figure 7:
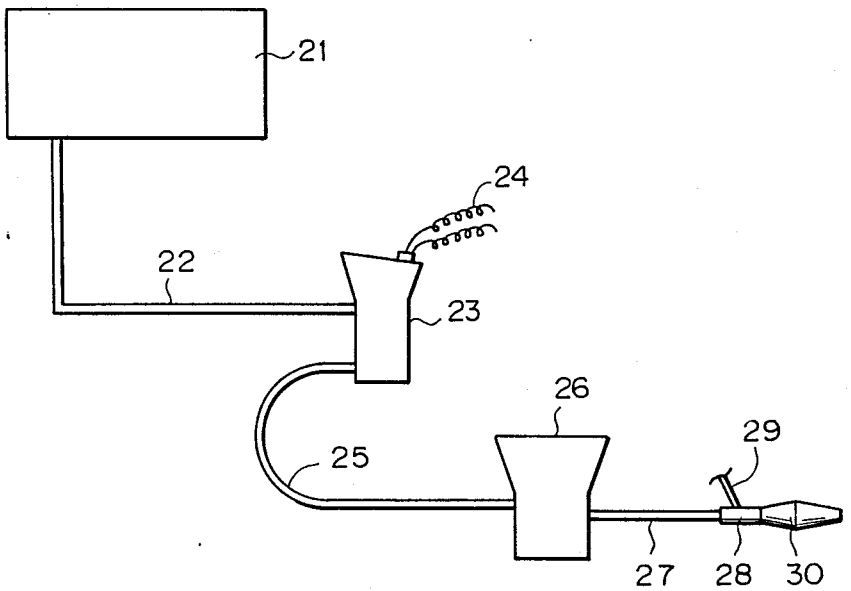
FIG. 7 is a flow chart of an example of the method of the present invention.

Referring to FIG. 7, a compressed air blast is produced by an air compressor 21 and is fed into a reinforcing short fiber-fluidizing device 23 through a conduit 22. In a portion of the fluidizing device 23, at least one bundle 24 of reinforcing fibers is cut into predetermined lengths, and the resultant reinforcing short fibers are introduced into the fluidizing device 23 and fluidized in the blast of compressed air therein.

The resultant flow of the reinforcing short fiber-containing blast of air is fed into a dry blender 26 through a conduit 25.

Separately, a mixture of an inorganic hydraulic material and an aggregate is introduced into the dry blender 26 and mixed with and fluidized in the flow of the reinforcing short fiber-containing blast of air therein.

The resultant flow of the dry blend fluidized in the flow of the blast of air is fed into a water-mixing device 28 through a conduit 27. Water is fed into the water-mixing device 28 through a conduit 29 and is mixed with the flow of the dryblend-containing blast of air. The resultant wet spraying composition is fed into the spray nozzle 30 and is sprayed through the nozzle 30.

Figure 8:
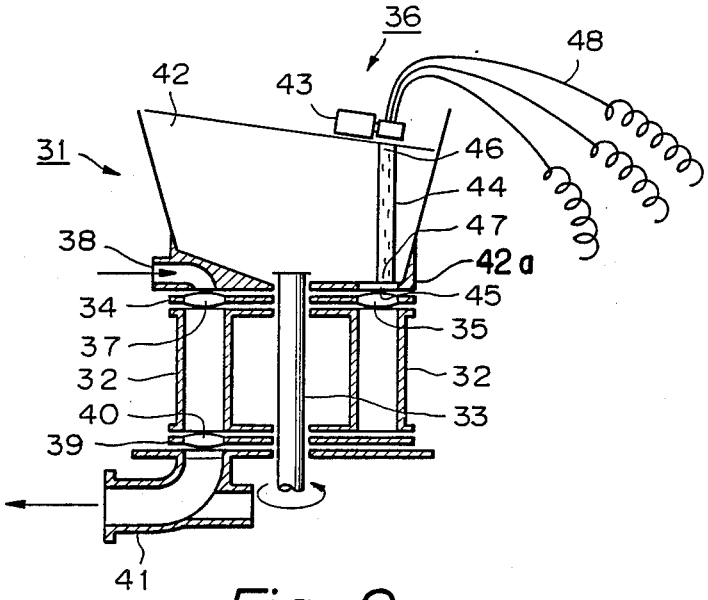
FIG. 8 is a cross-sectional view of an embodiment of the fluidizing device usable for the present invention.

Referring to FIG. 8, a reinforcing short fiber-fluidizing device 31 is provided with a plurality of vertical hollow cylinders 32 arranged around a vertical rotation axis 33 and rotatable around the axis 33, a fixed ceiling plate 34 sealing the top opening of the cylinders 32 and having a first opening 35 through which one of the cylinder 32 is connected to a supply source 36 of reinforcing short fibers and a second opening 37 through which another one of the cylinders 32 is connected to the supply source (not shown in the drawing) of the blast of compressed air through a conduit 38, and a fixed bottom plate 39 sealing the bottom openings of the cylinder 32 and having a bottom opening 40 through which one of the cylinders 32 which is connected to the supply source of the blast of compressed air through the second opening 37 of the fixed ceiling plate 34, is connected to a dry blender (not shown in this drawing) through a conduit 41.

The fluidizing device may be directly connected to the supply source 36 of the reinforcing short fibers, as shown in FIG. 8.

In FIG. 8, the reinforcing short fiber-supply source 36 is a hopper 42 provided with a cutter 43 and a short fiber-feeding pipe 44. The hopper 42 has a bottom 42*a* and a bottom opening 45 formed in the bottom 42*a*. The bottom opening 45 is connected to one of the cylinders 32 through the first opening 35 of the ceiling plate 34. The short fiber feeding pipe has a top end opening 46 located just below the cutter 43 and a bottom end opening 47 located just above the bottom opening 45 of the hopper bottom 44.

In the fluidizing device 31 shown in FIG. 8, the cylinders 32 are rotated around the axis 33 so that one of the cylinders 32 is connected to the supply source 36 of reinforcing short fibers through a first opening 35 of the ceiling plate 34, to allow an amount of the reinforcing short fibers to be introduced into one of the cylinders 32. When the cylinder containing the reinforcing short fibers reaches a position at which the cylinder is connected to the supply source of a blast of compressed air (not shown) through a second opening 37 of the ceiling plate 34 and a conduit 38 and to a dry blender (not shown) through a opening 40 of the bottom plate 39, the flow of the blast of compressed air is introduced into the cylinder 32 and fluidized the reinforcing short fibers contained in the cylinder 32, and then the resultant reinforcing short fiber-containing flow of the blast of air is blown from one of the cylinders 32 into the dry blender (not shown) through the opening 40 of the bottom plate 39 and the conduit 41.

In FIG. 8, at least one reinforcing fiber bundle 48 is fed to the cutter 43 and is cut into predetermined lengths. The resultant short fibers are fed into one of the cylinders 32 through the pipe 44, the opening 45 of the hopper bottom 42*a*, and the first opening 35 of the ceiling plate 34. Optionally, the cut short fibers can be contained in the hopper 42 and supplied therefrom into the fluidizing device 31 through the opening 45 of the hopper bottom 42*a*.

Figure 9:
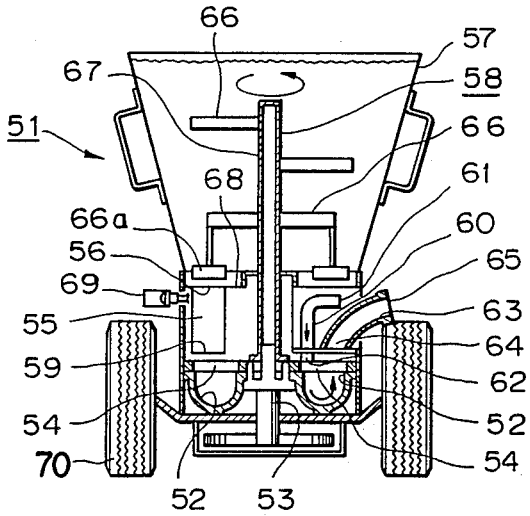
FIG. 9 is a cross-sectional view of an embodiment of the dry blender usable for the present invention.

Referring to FIG. 9, a dry blender 51 is provided with a plurality of feed bowls 52 arranged around a vertical rotation axis 53, each bowl 52 having an upper opening 54; a vertical feed duct 55 having a top opening 56 connected to a supply source of a dry mixture of an inorganic hydraulic material and an aggregate, for example, a dry mixture-supply hopper 57 with an agitater 58, and a bottom opening 59 directed to one of the feed bowls 52; a feed conduit 60, for flow of a reinforcing short fiber-fluidizing blast of compressed air, having a rear end opening 61 connected to a reinforcing short fiber-fluidizing device (not shown in this drawing) and having a front end opening 62 connected to another one of the feed bowls 52, and a delivery conduit 63 having a rear end opening 64 connected to the same feed bowl as that connected to the feed conduit 60 and a front end opening 65 connected to a water-mixing device (not shown in this drawing).

In FIG. 9, the agitator 58 in the hopper 57 has a plurality of agitating blades 66 and a plurality of feeding blades 66*a*, and rotates around a vertical shaft 67. The hopper 57 has a bottom 68 having a bottom opening through which the hopper 57 is connected to the top end opening 56 of the vertical feed duct 55.

In the operation of the dry blender 51 shown in FIG. 9, the feed bowls 52 are rotated around a vertical axis 53. When one of the feed bowls 52 reaches a position just beneath the vertical feed duct 55, an amount of the dry mixture in the hopper 57 is fed into the bowl 52 through the vertical feed duct 55. This feed is accelerated by the feeding blades 66*a* and a vibrator 69.

When the feed bowl 52 containing the dry mixture reaches a position just beneath the front end opening 62 of the feed conduit 60 and the rear end opening 64 of the delivery conduit 63, the flow of the reinforcing short fibers fluidized in the blast of compressed air is blown into the bowl 52, the dry mixture is fluidized in the reinforcing short fiber-containing blast of compressed air and the resultant dry blend of the dry mixture with the reinforcing short fibers is blown from the bowl 52 through the delivery conduit 63 by the blast of compressed air. The above-mentioned type of dry blender is effective for feeding the dry mixture into the flow of the reinforcing short fiber-containing blast of compressed air at a predetermined feed rate. Also, the resultant dry blend is evenly fluidized in the compressed air blast and can be fed into a water-mixing device at a predetermined feed rate.

The dry blender with the hopper may be provided with at least one pair of wheels 70 as shown in FIG. 9, to be movable.

The above-mentioned dry blender can be utilized to prepare a dry blend evenly fluidized in a blast of compressed air which does not contain the reinforcing short fibers. The resultant flow of the dry blend in the blast of air can be utilized to prepare a wet spraying composition having a uniform composition and evenly fluidized together with water in the blast of air.

The method and apparatus of the present invention are very effective for preparing a wet spraying composition containing an inorganic hydraulic material, an aggregate, and reinforcing short fibers evenly mixed with each other at a predetermined composition thereof. In the preparation of the wet spraying composition, undesirable breakage, fibrillation, and intertwining of the reinforcing short fibers are substantially prevented. Also, the preparation procedure can be easily controlled by a small number of workers, further, the spraying operation is very easy because the spray nozzle is relatively light and small.

Furthermore, the sprayed composition has a high quality.

The present invention will be further explained by way of specific examples, which, however, are merely representative and do not restrict the scope of the present invention in any way.

EXAMPLE 1

A hardened cement test block having a length of 53 cm, a width of 15 cm, and a thickness of 15 cm was produced by using the spraying apparatus as shown in FIGS. 2 and 3.

Referring to FIGS. 2 and 3, a dry mixture of one part of cement with 3 parts of aggregate consisting of sand was ejected at a supply rate of about 28 kg/min into the blending region 12*c* in the blending tube 12 by a first blast of compressed air. Reinforcing short fibers consisting of glass short fibers having an average diameter of 13 μm and an average length of 25 mm, or steel short fibers having an average diameter of 0.5 mm and an average length of 25 mm, or carbon short fibers having an average diameter of 8 μm and an average length of 10 mm, or water-insolubilized polyvinyl alcohol fibers having an average diameter of 0.3 mm and an average length of 25 mm, were ejected at a supply rate of about 1 kg/min into the blending region 12*c* by a second blast of compressed air.

The glass short fibers were used in an amount of $\frac{1}{3}$ based on the weight of the dry mortar (the dry mixture of cement with sand,) and the steel fibers in an amount of $\frac{1}{4}$ based on the weight of the dry mortar.

The first blast of compressed air was merged with the second blast of compressed air in the blending region 12, and the resultant merged blast made to flow through the water-mixing region 14.

Water was fed at a feed rate of about 32 kg/min into the water-mixing region 14 through the flexible hose 18, the feeding conduit 14*e*, the annular chamber 14*d*, and the feeding holes 14*f*.

The water was fed in an amount of 50% based on the dry weight of the cement. The resultant wet composition was sprayed to form the test block. In the resultant test block, the value of $V_f$(cement volume percent) was 1.5%.

Figure 4:
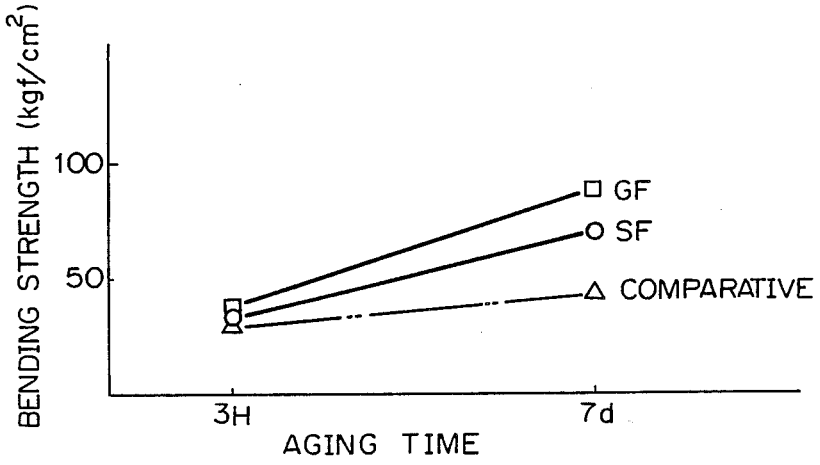
FIG. 4 is a graph showing a relationship between a blending strength and an aging time of test cement blocks produced by the method of the present invention and by a conventional method.

Referring to FIG. 4, the glass short fiber-containing cement block (GF) and the stainless steel short fiber-containing cement block (SF) exhibited excellent bending strengths at aging times of 3 hours and 7 days, compared to those of a comparative cement block which did not contain reinforcing short fibers.

It should be noted that, when the method and apparatus of the present invention was applied, the resultant glass short fiber-containing cement block exhibited a higher bending strength at aging times of 3 hours and 7 days than that of the stainless steel fiber-containing cement block.

Figure 5:
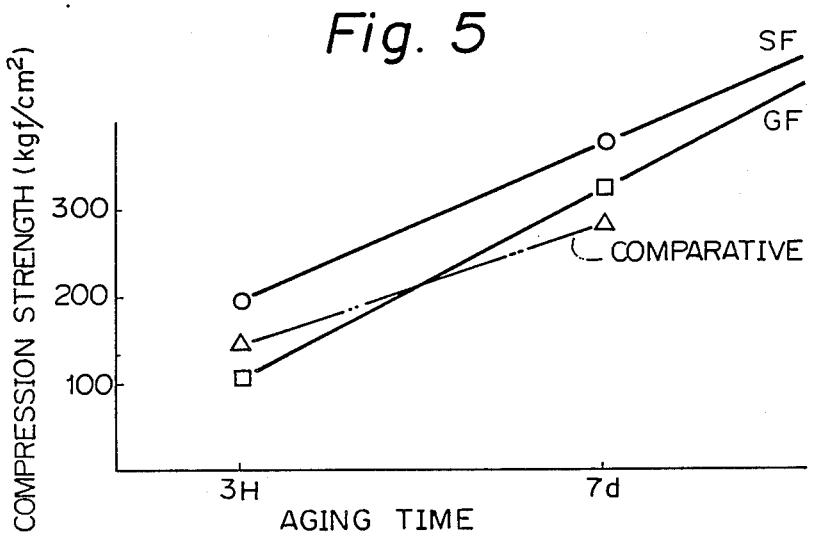
FIG. 5 is a graph showing a relationship between a compression strength and an aging time of test cement blocks produced by the method of the present invention, and by a conventional method.

Referring to FIG. 5, the stainless steel short fiber-containing cement block (SF) exhibited a superior compression strength, compared to that of the reinforcing short fiber-free comparative cement block at both aging times of 3 hours and 7 days. The glass short fiber-containing cement block (GF) exhibited a superior compression strength compared to that of the reinforcing short fiber-free comparative cement block, after an aging time of 7 days, and the compression strength of the glass short fiber-containing cement block was lower than that of the comparative cement block at an aging time of 3 hours.

Figure 6:
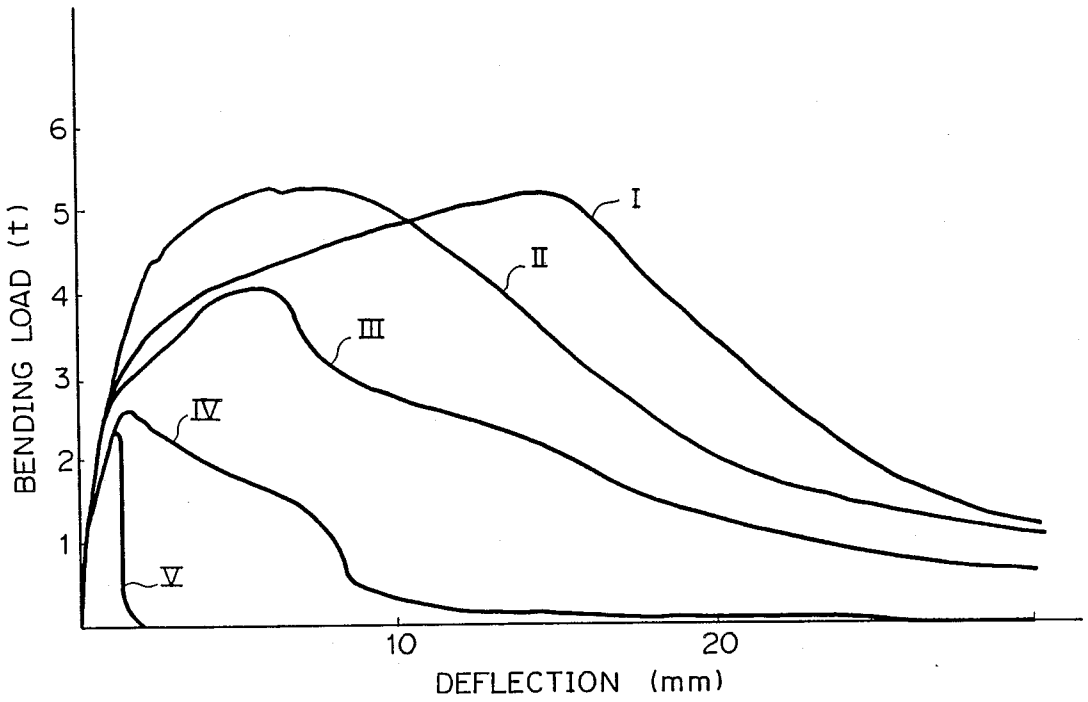
FIG. 6 is a graph showing a relationship between bending loads and deflections of test cement blocks produced in accordance with the present invention, and in accordance with conventional methods.

FIG. 6 shows that the carbon short fiber-containing cement block (curve I), the glass short fiber-containing cement block (curve II), and the water-insolubilized polyvinyl alcohol fiber-containing cement block (curve III) produced in accordance with the method of the present invention exhibited a remarkably higher resistance to deflection under a bending load than that exhibited by the comparative glass short fiber-containing cement block (curve IV) produced by a conventional method and that exhibited by the comparative short fiber-free cement block (curve V).

EXAMPLES 2 and 3

In Example 2, a hardened cement test block having a length of 15 cm, a width of 15 cm, and a thickness of 15 cm was produced by using the spraying apparatus as shown in FIG. 7. This spraying apparatus had a reinforcing short fiber-fluidizing device as shown in FIG. 8, a dry blender as shown in FIG. 9, and a water-mixing device as shown in FIGS. 2 and 3.

Referring to FIGS. 2, 3, 7, 8, and 9, bundles 48 of reinforcing glass fibers having an average diameter of about 0.5 mm were cut by a cutter 43 to provide reinforcing short fibers having a length of 25 mm; the resultant reinforcing short fibers were fed into a fluidizing device 31 and were fluidized by a blast of compressed air, which was ejected into the fluidizing device 31; the resultant flow of the reinforcing short fibers was fed into a dry blender 51 at an enforcing short fiber feed rate of about 1 kg/min. Separately, a dry mixture of one part of a super rapid hardening cement with 3 parts of aggregate consisting of sand was fed into the dry blender 51 at a feed rate of about 28 kg/min, and was evenly mixed with the reinforcing short fibers. The resultant dry blend was evenly fluidized in the blast of compressed air and fed into the water-mixing device 28 into which water was ejected at a feed rate of about 32 kg/min. The amount of the fed water corresponded to 50% of the dry weight of the cement in the dry blend. The resultant wet spraying composition was sprayed into a block mold and hardened in the mold. In the resultant block, the volume content ($V_f$) of the reinforcing short fibers was 1.5% based on the volume of the wet spraying composition.

The resultant block was subjected to a bending test. The result is shown by curve VI in FIG. 10. In Example 3, the same procedures as those described above were carried out except that the preparation of the dry blend fluidized in a blast of compressed air was carried out by using the apparatus as sown in FIGS. 2 and 3. The test result is shown by curve VII in FIG. 10.

Further, the same cement block as that mentioned above was produced by a conventional method. The test result is shown by curve VIII in FIG. 10.

Furthermore, the same cement block containing no reinforcing short fibers was prepared. The test result is indicated by curve IX in FIG. 10.

Figure 10:
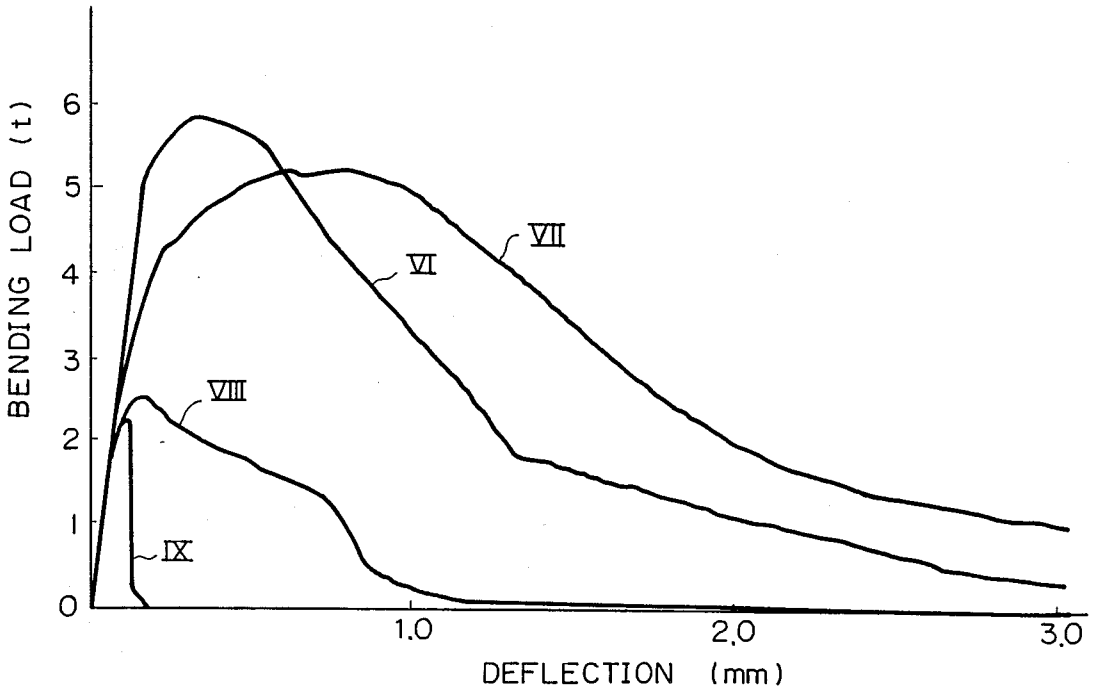
FIG. 10 is a graph showing a relationship between bending loads and deflections of test cement blocks produced in accordance with the methods of the present invention and two different conventional methods.

FIG. 10 shows that the cement blocks of Examples 2 and 3 produced in accordance with the present invention exhibited a significantly enhanced bending strength and toughness in composition with the comparative cement blocks (curves VIII and IX).

FIG. 10 also shows that, in Example 2 therein the dry mixture was directly mixed with the reinforcing short fibers in the dry blender as shown in FIG. 9, the resultant cement block exhibited an enhanced bending strength to that produced in Example 3 by the apparatus shown in FIG. 2 in which the dry mixture is fluidized in an additional blast of compressed air. The cement block produced in Example 3 by the apparatus shown in FIG. 2 exhibited an improved toughness.

EXAMPLES 4, 5 and 6

In each of Examples 4, 5 and 6, the same procedures as those described in Example 2 were carried out except that the cement was an ordinary Portland cement and contained a rapid hardening agent, the weight ratio of sand (aggregate) to cement was 0.75:1, the weight ratio of water to cement was 1:2, the value of $V_f$, which refers to a content of the reinforcing short fibers based on the volume of the spraying composition, was 1.0% (Example 4), 1.5% (Example 5) or 2.0% (Example 6), and the test piece had a length of 10 cm, a width of 10 cm, and a thickness of 40 cm.

The $V_f$ was controlled to a desired value by varying the content of the reinforcing short fibers. Also the aging time for the test piece was 7 days.

Figure 11:
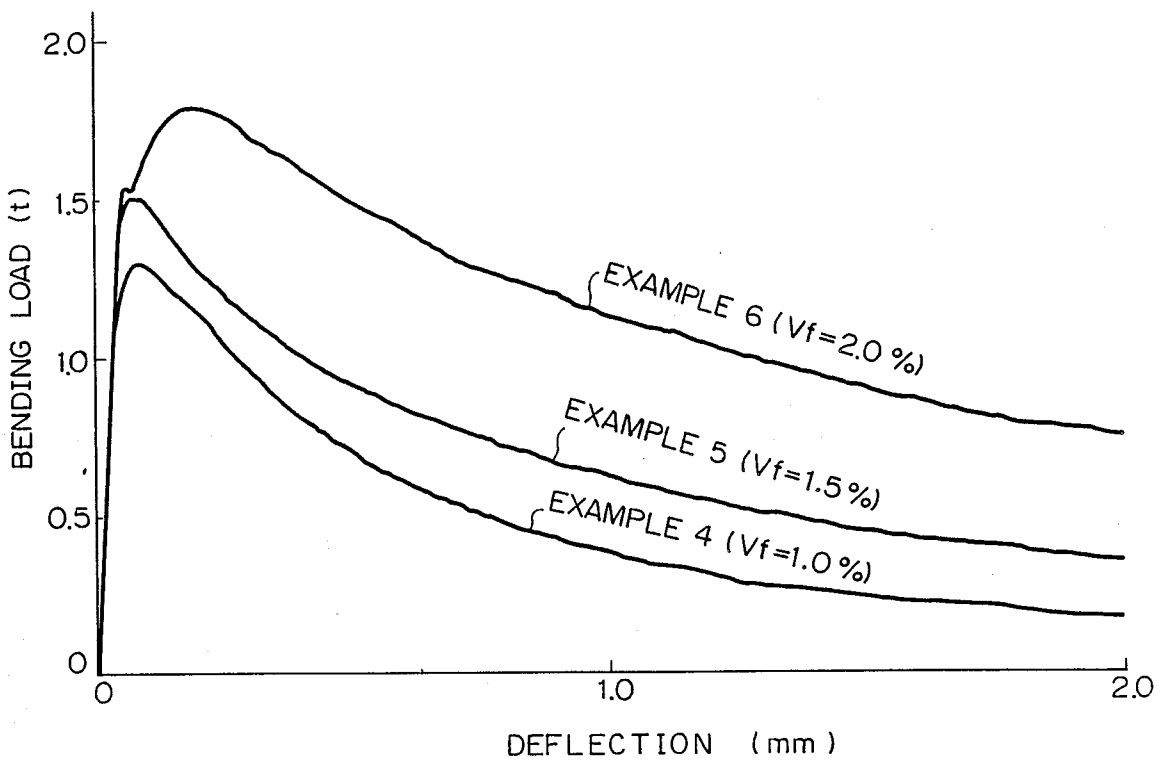
FIG. 11 is a graph showing a relationship between bending loads and deflections of test cement blocks having different contents of the reinforcing short fibers and produced in accordance with the method of the present invention.

FIG. 11 shows that all the test pieces of Examples 4, 5 and 6 exhibited a satisfactory heading strength.

We claim:

1. A method for spraying a wet composition containing an inorganic hydraulic material and a reinforcing material through a spray nozzle by means of a blast of compressed air, said method comprising the steps of:

blowing a blast of compressed air from a single supply source thereof into a short fiber-fluidizing region, while feeding dry reinforcing short fibers to the short fiber-fluidizing region, to provide a compressed air blast containing the dry reinforcing short fibers;

allowing a dry mixture of an inorganic hydraulic material with an aggregate to fall down into a dry blending region;

introducing the dry reinforcing short fiber-containing compressed air blast into the dry blending region to fluidize the dry mixture and to provide a flow of a dry blend consisting of the inorganic hydraulic material, aggregate, and reinforcing short fibers fluidized in the compressed air blast;

introducing the flow of the dry blend fluidized in the compressed air blast into a water-mixing region, while spouting at least one flow of water into the water-mixing region to fluidize fine particles of water and to provide a flow of a wet spraying composition consisting of the inorganic hydraulic material, aggregate, reinforcing short fibers and water uniformly mixed and fluidized together in the compressed air blast; and spraying the wet spraying composition through a spray nozzle.

2. The method as claimed n claim 1, wherein the inorganic hydraulic material is a cement.

3. The method as claimed in claim 1, wherein the reinforcing short fibers are selected from the group consisting of glass short fibers, aromatic polyamide short fibers, carbon short fibers and metal short fibers.

4. The method as claimed in claim 1, wherein the reinforcing short fibers have an average diameter of from 10 μm to 1 mm and an average length of from 5 to 60 mm.

5. The method as claimed in claim 1, wherein the reinforcing short fibers are in an amount of from 0.5% to 5% based on the volume of the spraying composition.

6. The method as claimed in claim 1, wherein the water is fed in an amount of from 30% to 70% based on the weight of the inorganic hydraulic material in the dry blend.

7. The method as claimed in claim 1, wherein the fed water is atomized by the blast of air in the water-mixing region.

8. The method as claimed in claim 1, wherein the flow of water fed into the water-mixing region is in a direction intersecting the direction of the flow of the dry blend in the water-mixing region.

9. The method as claimed in claim 1, wherein the flow of the wet spraying composition is disturbed while flowing through the spraying nozzle, to enhance the distribution of the material contained in the wet spraying composition.

10. An apparatus for spraying a wet composition containing an inorganic hydraulic material and a reinforcing material by means of a blast of compressed air, said apparatus comprising:

a single source of a supply of a blast of compressed air;

a fluidizing device having a fluidizing space formed therein, said fluidizing device connected to the source of supply of the blast of compressed air and connected to a source of supply of reinforcing short fibers, wherein a flow of reinforcing short fibers fluidized in the blast of compressed air is provided;

a dry blender having a dry blending space formed therein and connected to the fluidizing device, said dry blender located below and connected to a source of supply of a dry mixture of an inorganic hydraulic material with an aggregate, wherein the dry mixture is allowed to fall down into the dry blending space and a flow of dry blend, containing the inorganic hydraulic material the aggregate and the reinforcing short fibers fluidized in the compressed air blast, is provided;

a water-mixing device having a water-mixing space formed therein, said water-mixing device connected to the dry blender and connected to a water-spouting device for spouting water into the water-mixing space, connected to a source of supply of water, wherein a flow of a wet composition consisting of the dry blend and water evenly mixed and fluidized together in the compressed air blast is provided; and a spray nozzle connected to the water-mixing device.

11. The apparatus as claimed in claim 10, wherein the water-mixing device is in the form of a tube having a front open end connected to the spray nozzle and a rear open end connected to the dry blender and is provided with the water spouting device in the form of a ring pipe surrounding the water-mixing space of the water-mixing device, connected to the source of supply of water, and having at least one water-spouting hole directed to the water-mixing space.

12. The apparatus as claimed in claim 10, wherein the fluidizing device is provided with a plurality of vertical hollow cylinders arranged around a vertical rotation axis and rotatable around that axis, a fixed ceiling plate sealing the top openings of the cylinders and having a first opening through which one of the cylinders is connected to the source of supply of the reinforcing short fibers and a second opening through which another one of the cylinders is connected to the source of supply of the blast of compressed air, and a fixed bottom plate sealing the bottom openings of the cylinders and having a bottom opening through which one of the cylinders which is connected to the source of supply of the blast of compressed air through the second top opening of the ceiling plate, is connected to the dry blender.

13. The apparatus as claimed in claim 12, wherein the fluidizing device is further provided with a cutter for cutting at least one reinforcing fiber bundle into predetermined lengths to prepare the reinforcing short fibers, and a hopper for containing the cut reinforcing short fibers, having a bottom hole connected to one of the cylinders through the second top opening of the fixed ceiling plate.

14. The apparatus as claimed in claim 10, wherein the dry blender is provided with a plurality of feed bowls arranged around a vertical rotation axis and rotatable around that axis and each having an upper opening, and a vertical feed duct having a top opening connected to the source of supply of the dry mixture and a bottom opening directed one of the feed bowls, a feed conduit having a rear end connected to the fluidizing device and a front end connected to another one of the feed bowls and a delivery conduit having a rear end opening connected to the same one of the feed bowls as that connected to the feed conduit, and a front end opening connected to the water-mixing device.

15. The apparatus as claimed in claim 14, wherein the dry blender is further provided with a hopper containing the dry mixture and having a bottom opening connected to the top opening of the vertical feed duct.

16. The apparatus as claimed in claim 10, wherein the source of supply of the reinforcing short fibers has a means for cutting at least one reinforcing fiber bundle to provide reinforcing short fibers having a predetermined length.

17. The apparatus as claimed in claim 10, wherein the spray nozzle is provided with at least one flow-disturbing terrace formed on the inside peripheral surface of the spray nozzle.

18. The apparatus as claimed in claim 10, wherein the spray nozzle is composed of a rear portion connected to the front open end of the water-mixing device and having a diameter which increases with an increase in the distance from the rear open end of the nozzle and front portion connected to the rear portion and having a diameter which decreases with an increase in the distance from the rear open end of the nozzle.

* * * * *